US010415160B2

(12) United States Patent
Chou

(10) Patent No.: US 10,415,160 B2
(45) Date of Patent: Sep. 17, 2019

(54) METHOD OF MANUFACTURING ONE-PIECE TEXTILE BY A JACQUARD MACHINE AND PRODUCT MADE BY THE SAME

(71) Applicant: Shen Feng Textile Co., Ltd., Changhua County (TW)

(72) Inventor: Hung-Ching Chou, Changhua County (TW)

(73) Assignee: Shen Feng Textile Co., Ltd. (TW)

( * ) Notice: Subject to any disclaimer, the term of this patent is extended or adjusted under 35 U.S.C. 154(b) by 127 days.

(21) Appl. No.: 15/661,737

(22) Filed: Jul. 27, 2017

(65) Prior Publication Data

US 2019/0032252 A1 Jan. 31, 2019

(51) Int. Cl.

| | |
|---|---|
| ***D03D 11/00*** | (2006.01) |
| ***D03D 13/00*** | (2006.01) |
| ***D03C 3/00*** | (2006.01) |
| ***D03C 19/00*** | (2006.01) |
| ***D03D 1/00*** | (2006.01) |
| ***A41B 1/08*** | (2006.01) |

(52) U.S. Cl.

CPC ..... *D03C 3/00* (2013.01); *A41B 1/08* (2013.01); *D03C 19/005* (2013.01); *D03D 1/00* (2013.01); *D03D 13/004* (2013.01); *A41B 2500/20* (2013.01)

(58) Field of Classification Search

CPC .. B63B 35/7913; A41D 27/145; A41D 27/24; D03D 11/02; D03D 1/02; D03D 3/02

See application file for complete search history.

(56) References Cited

U.S. PATENT DOCUMENTS

| | | | | |
|---|---|---|---|---|
| 2004/0168479 | A1* | 9/2004 | McMurray | D02G 3/326 66/202 |
| 2009/0077771 | A1* | 3/2009 | Baba | A41F 17/02 24/72.1 |
| 2012/0246802 | A1* | 10/2012 | Wong | A41D 27/145 2/236 |
| 2016/0281273 | A1* | 9/2016 | Candrian-Bell | D06N 3/0006 |

* cited by examiner

*Primary Examiner* — Robert H Muromoto, Jr.
(74) *Attorney, Agent, or Firm* — Lerner, David, Littenberg, Krumholz & Mentlik, LLP

(57) ABSTRACT

A method of manufacturing a one-piece textile by a jacquard machine includes a preparation step, a jacquard weaving step, a textile separation step, and a textile ironing step. A woven cloth is made of the method and includes a base fabric and multiple textiles connected with the base fabric by at least one sewing area. The woven cloth is a one-piece structure made by a jacquard machine. The textiles are separated by trimming the at least one sewing area from the woven cloth. Each textile is a complete product with a one-piece structure without sewing. The manufacturing method can improve the efficiency of textile production.

14 Claims, 11 Drawing Sheets

METHOD OF MANUFACTURING ONE-PIECE TEXTILE BY A JACQUARD MACHINE AND PRODUCT MADE BY THE SAME

BACKGROUND OF THE INVENTION

1. Field of the Invention

The present invention relates to a weaving method, especially to a method of manufacturing a one-piece textile by a jacquard machine and a product made by the same.

2. Description of Related Art

An industrial manufacture mode applied to the conventional weaving method is already very mature. For example, the conventional cloth manufacturing proceeds with the following steps. A designer designs clothing patterns and selects a series of suitable fibers and yarns. After selecting fibers and yarns, the staff proceeds to do a registration process, which will waste a lot of cloth and time. Next is a fabric relaxation process in which the cloth is elongated for a period of time, and is then left waiting till shrinking into a fixed shape for a trimming process. The fabric can be cut by a trimming machine or manually according to the clothing pattern. In the trimming process, if any error occurs to the scissors operation, the cloth may be destroyed, so an experienced staff is necessary to trim the cloth into many pieces.

Finally, the pieces of the cloth are respectively sewn by machine or manually to form a shirt 30 in FIGS. 9 to 11. The sewing process is an important process that connects many pieces of cloth as the shirt 30 by division of labor. The sewing process requires precision, skill, patience, and good vision to combine every piece of cloth by needles and threads. If any error occurs, redoing all the processes will delay the entire production line.

Therefore, the shirt 30 has multiple seams 31 formed between every two pieces of cloth. With reference to FIG. 11, each seam 31 is formed by two threads respectively sewn through and surrounding at least two pieces of fabric.

Some clothing has patterns formed by screen printing, ink-jet printing, or jacquard weaving to show particular logos or graphic patterns. After inspection and packing, the clothing manufacturing process is completed.

However, some clothing manufacturing process is hard to be replaced by automatic manufacturing because the pattern design, the material, and weaving method are different. The cost in the trimming process and sewing process is still very high.

To overcome the shortcomings of the conventional manufacturing process, the present invention provides a method of manufacturing one-piece textile by a jacquard machine and a product made by the same to mitigate or obviate the aforementioned problems.

SUMMARY OF THE INVENTION

The main objective of the present invention provides a method of manufacturing a one-piece textile by a jacquard machine and a product made by the same.

The method of manufacturing a one-piece textile by a jacquard machine includes a preparation step, a jacquard weaving step, a textile separation step, and a textile ironing step. A woven cloth is made of the said method and includes a base fabric and multiple textiles connected with the base fabric by at least one sewing area.

The woven cloth is a one-piece structure and is made by a jacquard machine. The textiles are separated by trimming the at least one sewing area from the woven cloth. Each textile is a complete product with a one-piece structure without sewing. The manufacturing method can greatly improve the efficiency of textiles production.

Other objects, advantages, and novel features of the invention will become more apparent from the following detailed description when taken in conjunction with the accompanying drawing.

DETAILED DESCRIPTION OF PREFERRED EMBODIMENT

Figure 1:
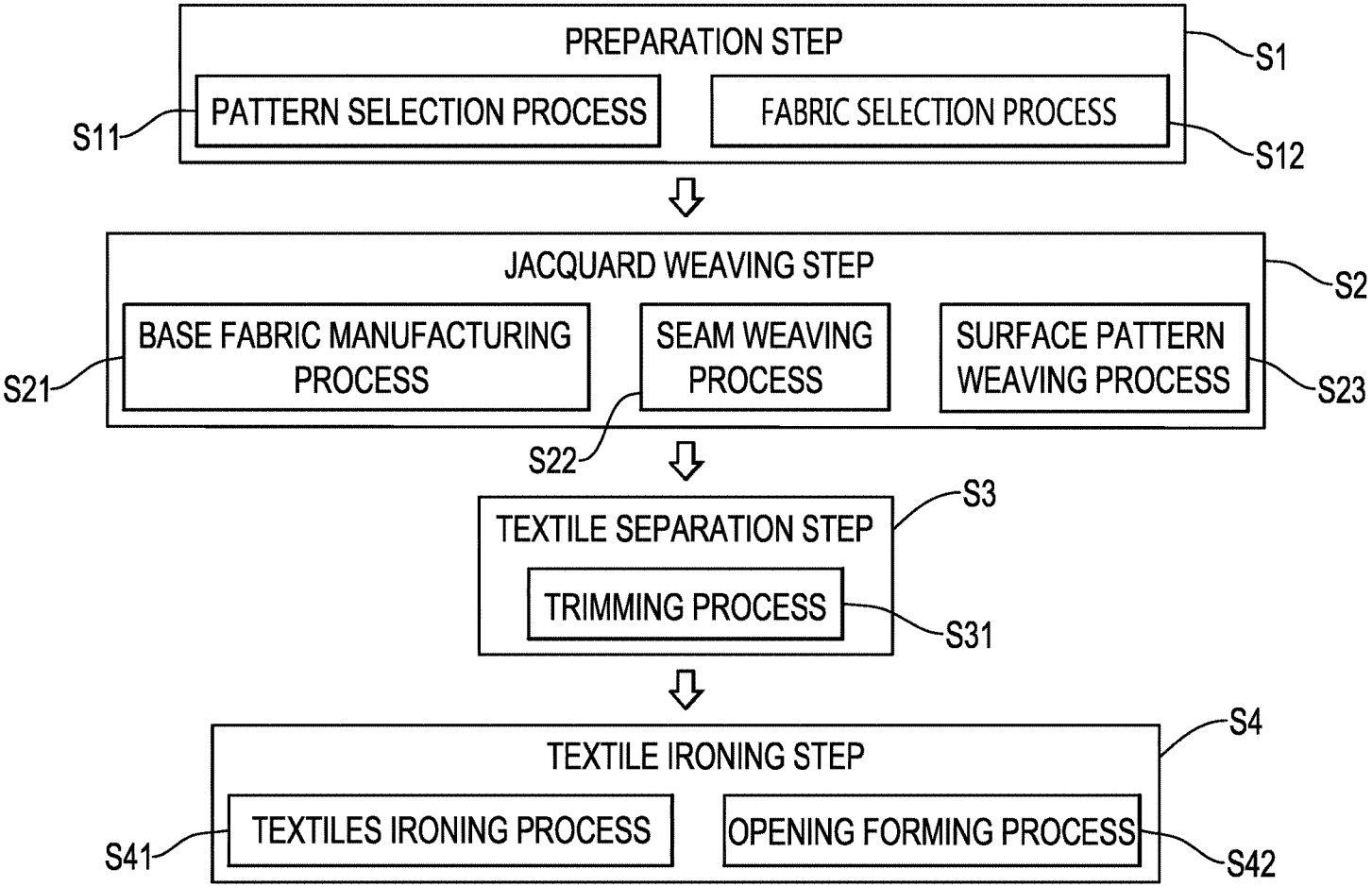
FIG. 1 is a block diagram of a method of manufacturing a one-piece textile by a jacquard machine in accordance with the present invention.

With reference to FIG. 1, a preferred embodiment of a method of manufacturing a one-piece textile by a jacquard machine includes the following steps: a preparation step S1, a jacquard weaving step S2, a textile separation step S3, and a textile ironing step S4.

The preparation step S1 includes a pattern selection process S11 and a fabric selection process S12. The pattern selection process S11 generates a program script in accordance with a textile pattern of an expected product through textile drawing, textile design, printing, and weaving method combined with clothing patterns. The program script is input in a jacquard machine for operating a weaving program.

The fabric selection process S12 selects fibers or yarns suitable to the textile pattern of the pattern selection process S11. The fibers or yarns can be selected from natural fibers, natural polymeric fibers, regenerated fibers, synthetic polymeric fibers, monofilament yarns, elastic fiber yarns, melt yarns or combinations thereof or functional yarns, e.g., anti-ultraviolet yarns, antibacterial yarns, heating yarns, moisture-conducting yarns, conductive metal yarns, luminous yarns or the like, or other fiber raw materials which can be applied to the jacquard weaving process.

Figure 2:
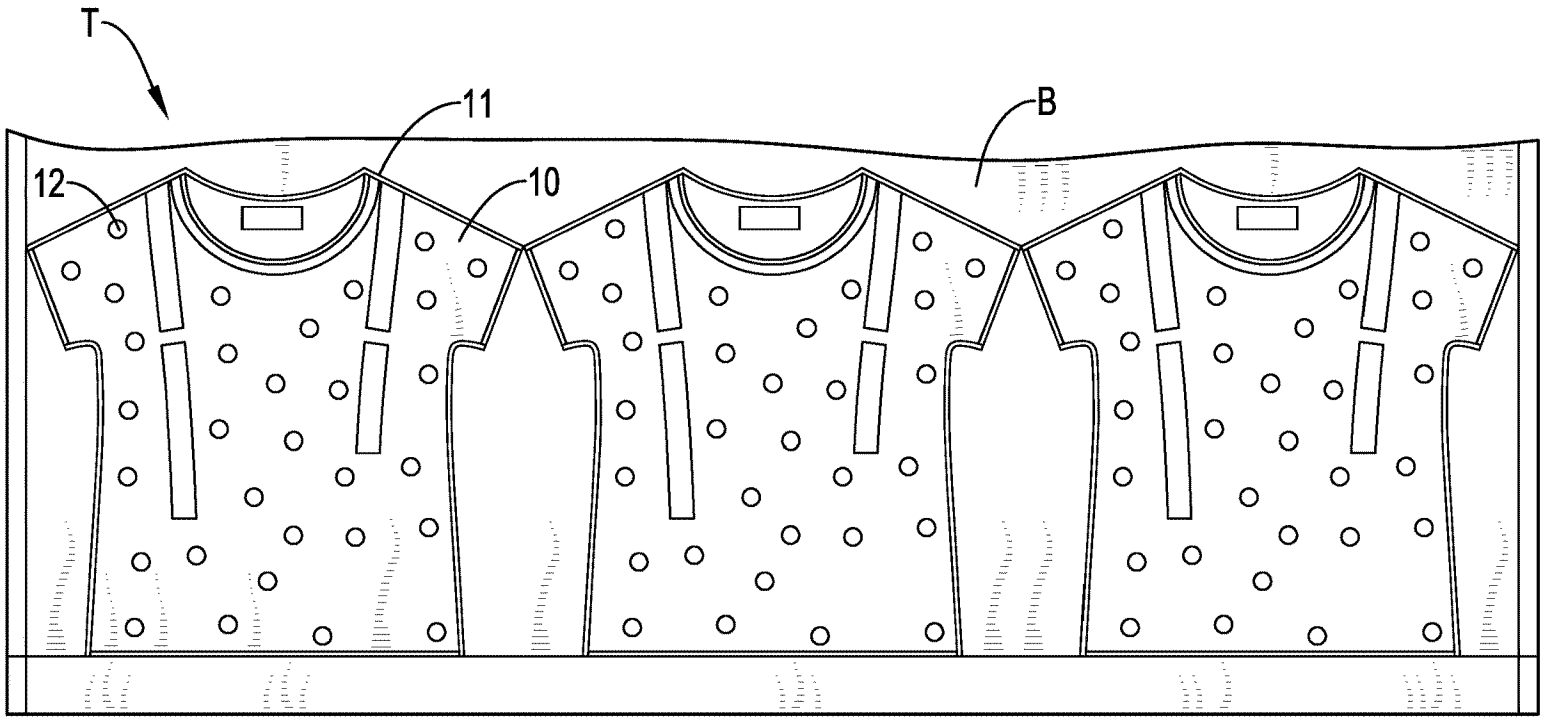
FIG. 2 is a schematic view of the method of manufacturing a one-piece textile by a jacquard machine in FIG. 1.

The jacquard weaving step S2 continues after the preparation step S1 is operated by the jacquard machine, and includes a base fabric manufacturing process S21, a seam weaving process S22, and a surface pattern weaving process S23. With reference to FIG. 2, a woven cloth T is a one-piece structure and is woven by the jacquard weaving step S2.

Figure 3:
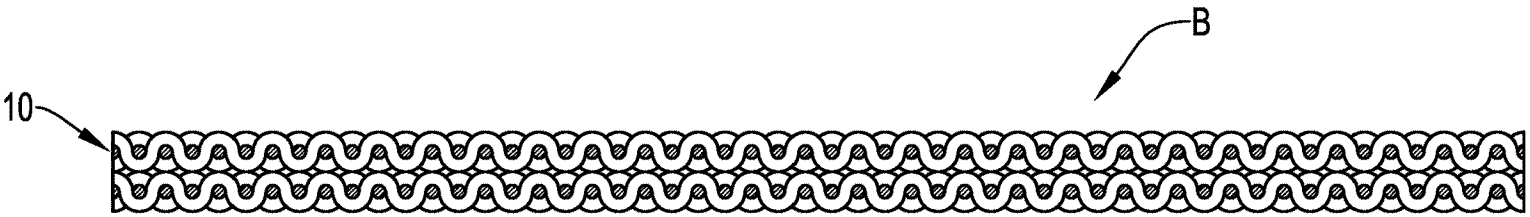
FIG. 3 is a cross-sectional schematic view of a base fabric of the method of manufacturing a one-piece textile by a jacquard machine in FIG. 1.

With reference to FIGS. 2 and 3, in the base fabric manufacturing process S21, a base fabric B is woven by warp threads and weft threads selected from the fabric selection process S12. The base fabric B includes two base layers 10 respectively interwoven by two warp threads and two weft threads in different weaving structures and separated from each other.

Figure 4:
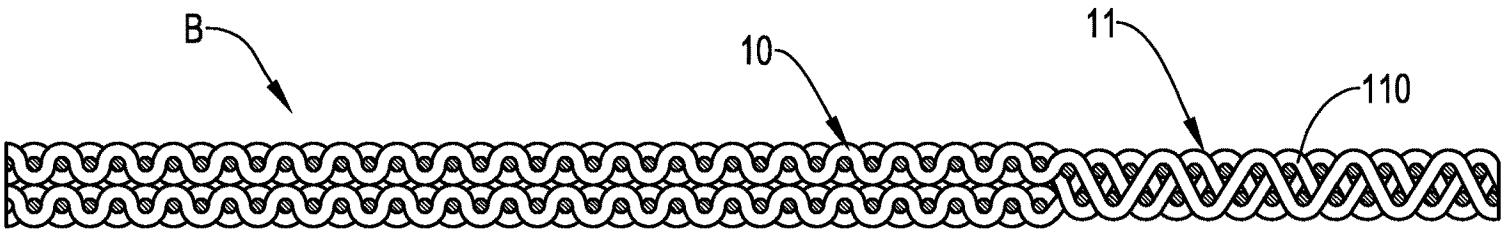
FIG. 4 is a cross-sectional schematic view of the base fabric and a sewing area of the method of manufacturing a one-piece textile by a jacquard machine in FIG. 1.

With reference to FIGS. 2 and 4, in the seam weaving process S22, at least one sewing area 11 is woven on the base fabric B according to the clothing pattern set in the program script of the pattern selection process S11. The at least one sewing area 11 is formed on the woven cloth T to enclose the two base layers 10 in a closed structure or a semi-closed structure, such as a single layer with multiple strands in the closed structure or double layers with multiple strands in the semi-closed structure. Each one of the at least one sewing area 11 includes an interwoven layer 110 that is a single layer with multiple strands interwoven by the warp threads and the weft threads of the base layers 10.

Preferably, the woven cloth T has multiple sewing areas 11 sequentially formed in the woven cloth T at spaced intervals. Each sewing area 11 is woven in a shirt contour and has two closed sleeves, a closed shirttail, and a closed collar. Or, each sewing area 11 can be combined with the closed and semi-closed structure to form a shirt contour or a bag, necktie, socks, etc, wherein each sewing area 11 combines a single layer with multiple strands and partial double layers with multiple strands.

Figure 5:
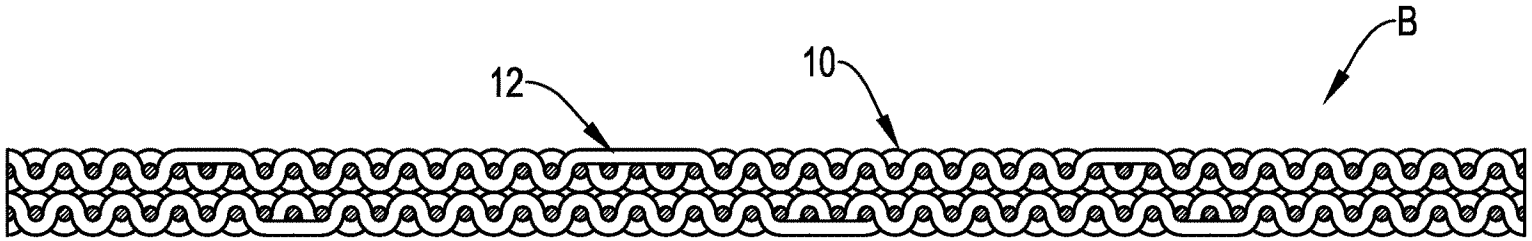
FIG. 5 is a cross-sectional schematic view of a pattern area of the method of manufacturing a one-piece textile by a jacquard machine in FIG. 1.

With reference to FIGS. 2 and 5, in the surface pattern weaving process S23, at least one surface pattern 12 is woven on any one of surfaces of the base fabric B according to the clothing pattern set in the program script of the pattern selection process S11. The at least one surface pattern 12 is stacked on the warp threads and the weft threads of one of the base layers 10, and has a particular contour. The weaving structure of the at least one surface pattern 12 is identical with or different from any one of the base layers 10 of the base fabric B. The at least one surface pattern 12 is set in the program script of the pattern selection process S11, so a registration process can be omitted.

Figure 6:
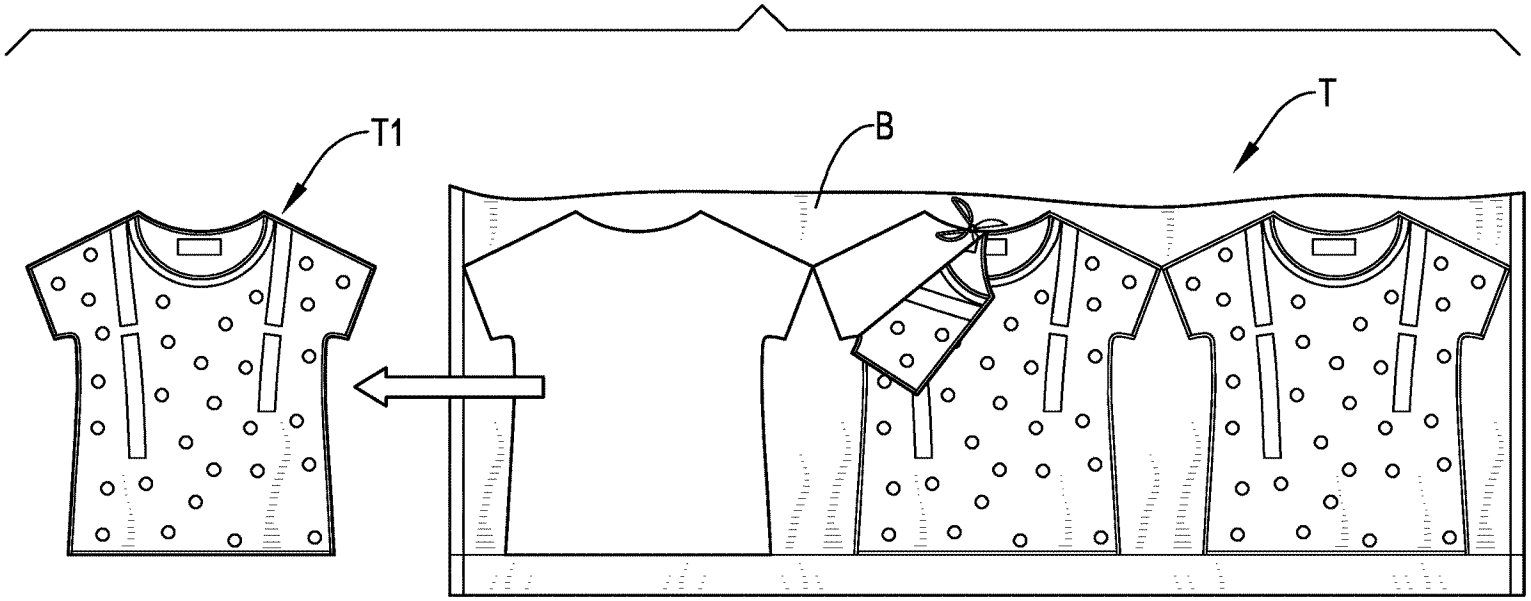
FIG. 6 is a schematic view of a manufacturing process of the method of manufacturing a one-piece textile by a jacquard machine in FIG. 1.

With reference to FIGS. 2 and 6, the textile separation step S3 is applied after the jacquard weaving step S2, and multiple textiles T1 are separated from the base fabric B of the woven cloth T by a trimming process S31. The trimming process S31 can adopt scissors, a trimming machine or a cutter or other ways to cut the outer peripheries of the sewing areas 11 of the woven cloth T.

With reference to FIGS. 2 and 6, preferably, each textile T1 is a piece of hollow cloth and includes two base layers 10 and a sewing area 11 sealed around the peripheries of the base layers 10. Each textile T1 in the preferred embodiment is a piece of cloth in the T-shirt shape.

Figure 7:
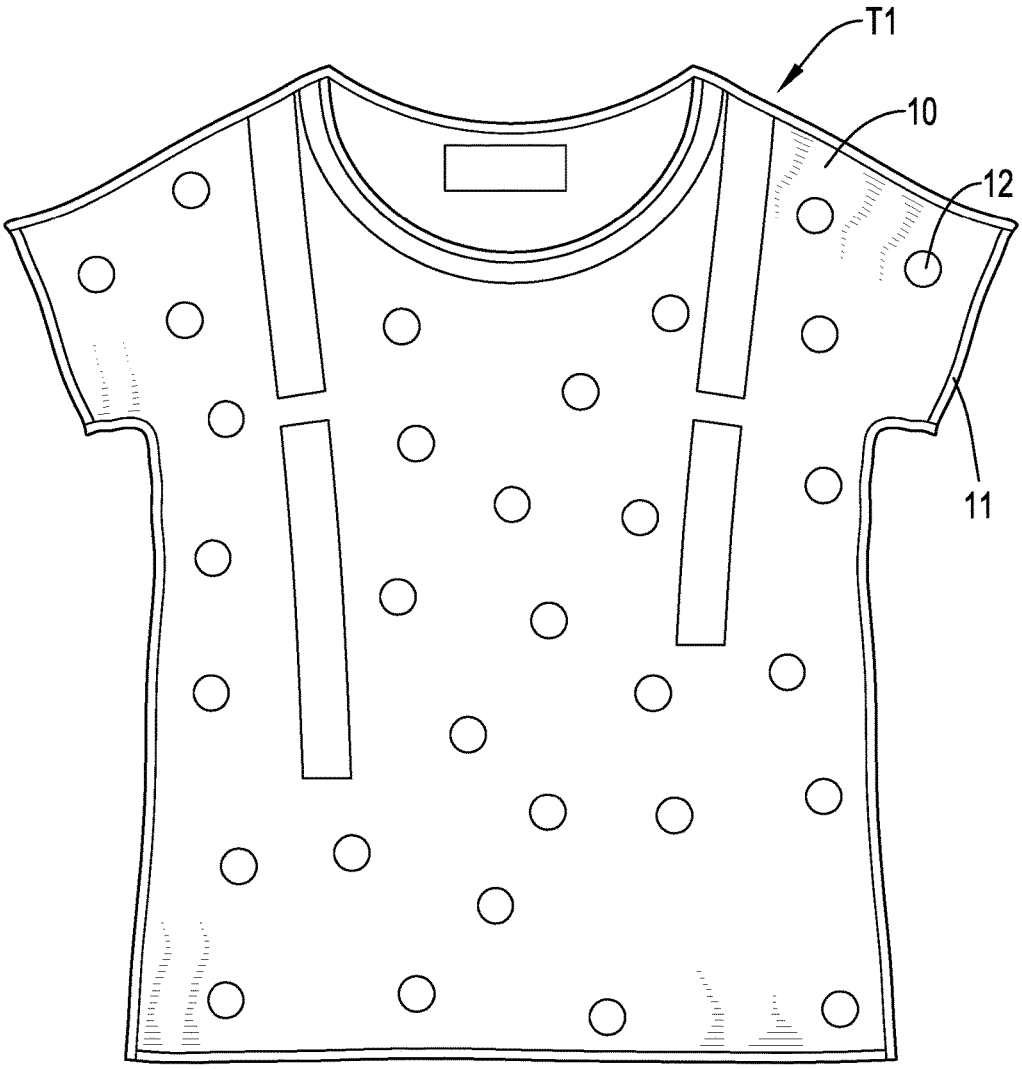
FIG. 7 is a schematic front view of a textile of the method of manufacturing a one-piece textile by a jacquard machine in FIG. 1.
Figure 8:
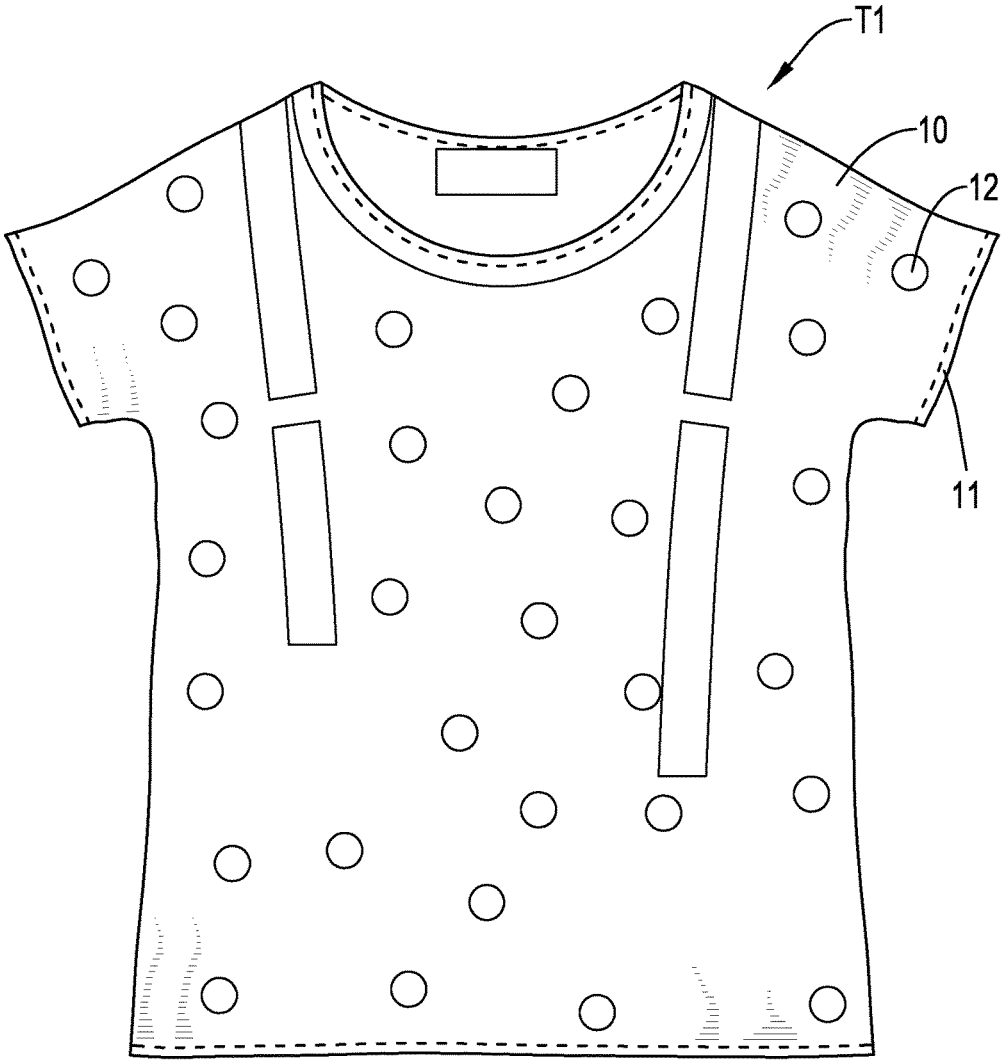
FIG. 8 is a schematic front view of the textile in FIG. 7, showing the textile turned inside out.
Figure 9:
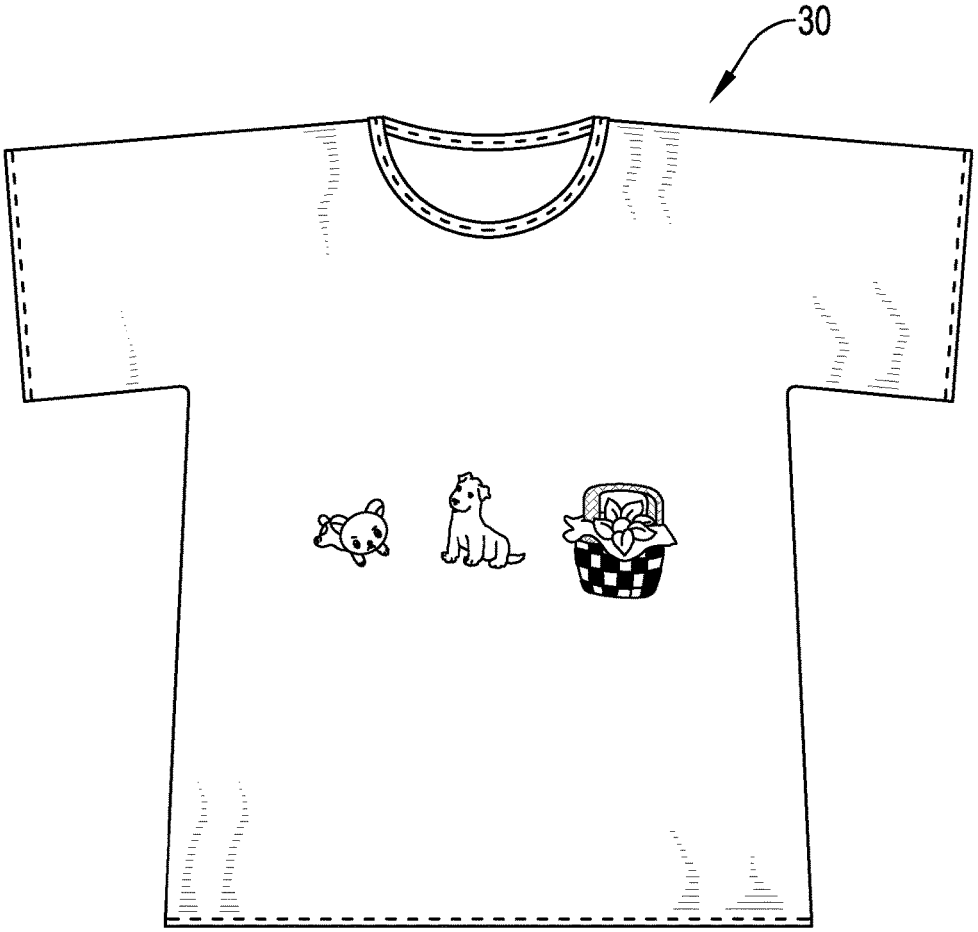
FIG.9 PRIOR ART
FIG. 9 is a schematic front view of a conventional shirt.
Figure 10:
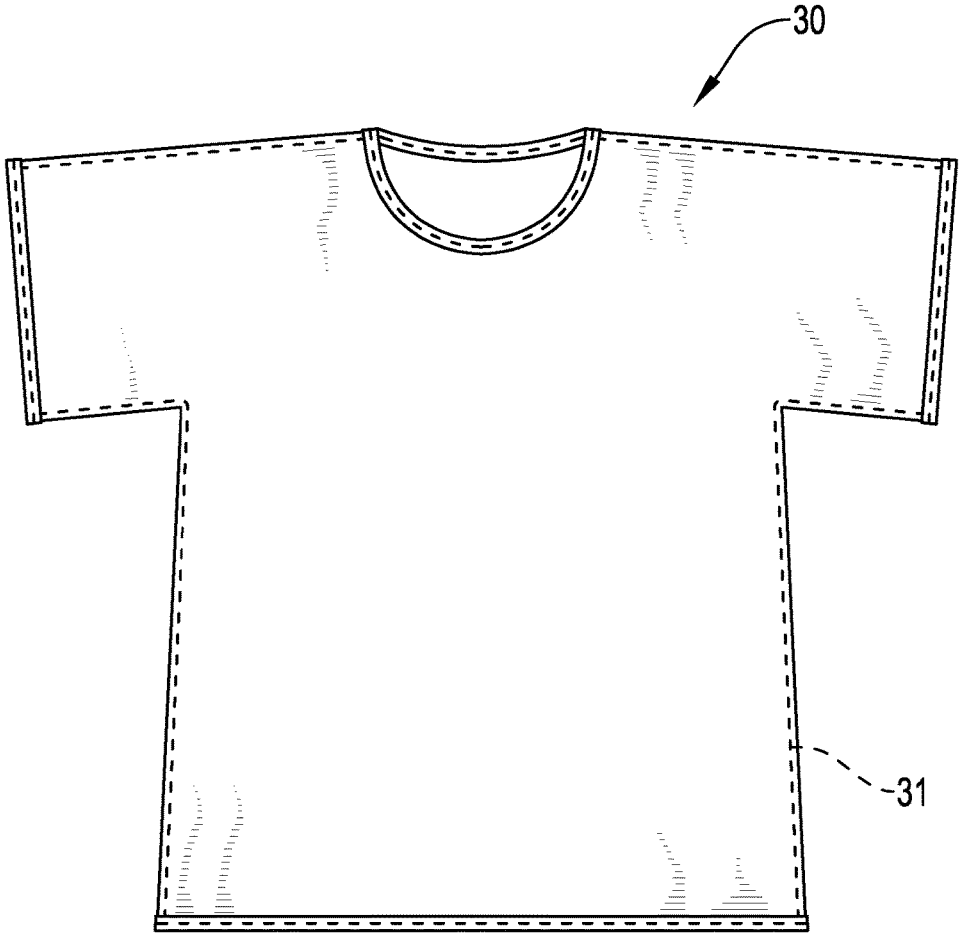
FIG.10 PRIOR ART
FIG. 10 is a schematic front view of the conventional shirt turned inside out.
Figure 11:
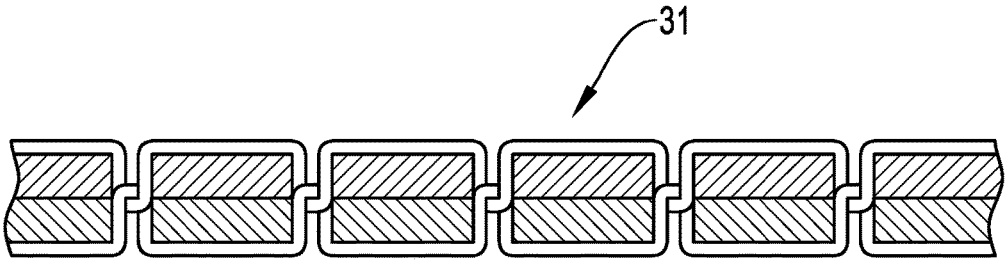
FIG.11 PRIOR ART
FIG. 11 is a cross-sectional schematic view of seams of the conventional shirt.

With reference to FIGS. 1, 7 and 8, the textile ironing step S4 is applied after the textile separation step S3. The textile ironing step S4 irons the outer surfaces of the textiles T1 by a textiles ironing process S41, and then turns the textiles T1 inside out to iron the inner surfaces of the textiles T1. The textiles ironing process S41 can be done manually, by automatic ironing or by steam ironing. In an opening forming process S42, the sewing areas 11 of the textiles T1 are cut at the cuffs, collar and shirttail to form an opening. The textiles T1 further need a simple sewing process for aesthetic appeal and a final ironing process to complete the textile product.

The method in accordance with the present invention can be applied to common textiles such as ties, drawstring bags, tote bags, shopping bags, masks, pants, dress, bedding and other textile products. The method in accordance with the present invention is mainly suitable to the textiles having a single or double layers of cloth with completely closed or partially closed sewing areas 11. The manufacturing process only needs to set the clothing pattern and the shape of the sewing areas, and then separates the textiles T1 from the woven cloth T to get a final product.

The method in accordance with the present invention omits most parts of the trimming process in pre-treatment and only needs a simple sewing process for aesthetic appeal in particular segments of textiles to complete the manufacturing process of textiles. The method of the present invention omits 80% sewing process and greatly reduces the cost of manufacturing and manpower, also omits or simplifies some processes such as registration process, fabric relaxation, trimming process, or inspection process in the conventional manufacturing process.

The method in accordance with the present invention simplifies the trimming process in an easy way that a staff only needs to operate scissors to cut the sewing area 11 of the woven cloth T to separate the textiles T1 from the base fabric B without using a trimming machine. The textile separation step S3 can even be outsourced to substantially reduce the work load of the production.

The clothing pattern may be applied with a breathable fiber with double layers and a plain weave structure, wherein the outer structure adopts jacquard weaving and the inner structure adopts leno weaving. The clothing pattern has the function of adjusting temperature and moisture of the human body in some particular body portions, improves the manufacturing process and strengthens the focus on the user's demand.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. A method of manufacturing a one-piece textile by a jacquard machine, the method comprising:

a preparation step including a pattern selection process generating a program script in accordance with a textile pattern of an expected product, and inputting the program script into a jacquard machine for operating a weaving program; and a fabric selection process selecting fibers or yarns suitable to the textile pattern of the pattern selection process;

a jacquard weaving step according to the textile pattern and including a base fabric manufacturing process forming at least two fabrics separated from each other by the jacquard machine, the at least two fabrics interwoven by at least two groups of warp threads and weft threads selected from the fabric selection process, the warp threads and weft threads having different weaving structures and separated from each other; and a seam weaving process forming at least one sewing area interwoven between the at least two fabrics, the at least one sewing area being a structure of a single layer with multiple strands interwoven by the at least two groups of warp threads and weft threads of the at least two fabrics; and a textile separation step separating at least one textile from the at least one sewing area by a trimming process.

2. The method as claimed in claim 1, wherein the jacquard weaving step further includes at least one surface pattern weaving process forming at least one surface pattern in at least one of the at least two fabrics; and each one of the at least one surface pattern has a contour, and a weaving structure of the at least one surface pattern is different from that of at least one of the at least two fabrics.

3. The method as claimed in claim 1, wherein the method further includes a textile ironing step after the textile separation step, comprising steps of ironing an outer surface of the at least one textile, and turning the at least one textile inside out to iron an inner surface of the at least one textile.

4. The method as claimed in claim 2, wherein the method further includes a textile ironing step after the textile separation step, and comprising steps of ironing the outer surface of the at least one textile, and turning the at least one textile inside out to iron the inner surface of the at least one textile.

5. The method as claimed in claim 1, wherein the trimming process adopts scissors, a trimming machine, or a cutter.

6. The method as claimed in claim 2, wherein the trimming process adopts scissors, a trimming machine, or a cutter.

7. The method as claimed in claim 3, wherein the trimming process adopts scissors, a trimming machine, or a cutter.

8. The method as claimed in claim 4, wherein the trimming process adopts scissors, a trimming machine, or a cutter.

9. A woven cloth manufactured by the method as claimed in claim 1, the woven cloth comprising:

a base fabric including two base layers interwoven by two groups of warp threads and weft threads separated from each other, weaving structures of the two groups of warp threads and weft threads being different; and at least one sewing area formed in the base fabric and having an interwoven layer having a structure of a single layer with multiple strands interwoven by the two groups of warp threads and the weft threads of the two base layers.

10. The woven cloth as claimed in claim 9, wherein the base fabric has multiple sewing areas formed in the base fabric at spaced intervals.

11. The woven cloth as claimed in claim 9, wherein the base fabric has at least one surface pattern in at least one surface of the base fabric;

each one of the at least one surface pattern has a contour, and a weaving structure of the at least one surface pattern is different from that of one of the two base layers of the base fabric.

12. The woven cloth as claimed in claim 10, wherein the base fabric has at least one surface pattern in at least one surface of the base fabric;

each one of the at least one surface pattern has a contour, and a weaving structure of the at least one surface pattern is different from that of one of the two base layers of the base fabric.

13. A textile manufactured by the method as claimed in claim 1, the textile being a piece of hollow woven cloth and comprising:

two base layers interwoven by two groups of warp threads and weft threads separated from each other, weaving structures of the two groups of warp threads and weft threads being different; and at least one sewing area formed around the peripheries of the two base layers, the two base layers formed by two groups of warp threads and weft threads, the at least one sewing area having a structure of a single layer with multiple strands interwoven by the two groups of warp threads and the weft threads of the two base layers.

14. The textile as claimed in claim 13, wherein the at least one sewing area seals the two base layers to form a closed or semi-closed contour in the textile.

* * * * *